US010041431B2

(12) United States Patent
Aso et al.

(10) Patent No.: US 10,041,431 B2
(45) Date of Patent: Aug. 7, 2018

(54) FUEL SUPPLY APPARATUS FOR INTERNAL COMBUSTION ENGINE

(71) Applicant: TOYOTA JIDOSHA KABUSHIKI KAISHA, Toyota-shi, Aichi-ken (JP)

(72) Inventors: Koji Aso, Toyota (JP); Hideaki Hayashi, Nagoya (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 210 days.

(21) Appl. No.: 14/749,725

(22) Filed: Jun. 25, 2015

(65) Prior Publication Data

US 2015/0377174 A1 Dec. 31, 2015

(30) Foreign Application Priority Data

Jun. 26, 2014 (JP) ..... 2014-131228

(51) Int. Cl.

| | |
|---|---|
| ***F02M 37/04*** | (2006.01) |
| ***F02D 41/30*** | (2006.01) |
| ***F02M 39/02*** | (2006.01) |
| ***F02M 59/46*** | (2006.01) |
| ***F02D 41/38*** | (2006.01) |

(52) U.S. Cl.

CPC ..... *F02D 41/3082* (2013.01); *F02D 41/3845* (2013.01); *F02D 41/3863* (2013.01); *F02M 39/02* (2013.01); *F02M 59/466* (2013.01); *F02D 2200/0602* (2013.01)

(58) Field of Classification Search

CPC ..... F02D 2200/0602; F02D 41/3082; F02D 41/3845; F02D 41/3863; F02M 39/02; F02M 59/466

See application file for complete search history.

(56) References Cited

U.S. PATENT DOCUMENTS

| | | | | | |
|---|---|---|---|---|---|
| 4,800,859 | A * | 1/1989 | Sagisaka | F02D 41/3082 | 123/459 |
| 5,406,922 | A * | 4/1995 | Tuckey | F02D 41/3082 | 123/41.31 |
| 5,699,772 | A * | 12/1997 | Yonekawa | F02D 41/3082 | 123/497 |
| 5,727,515 | A | 3/1998 | Biester | | |

(Continued)

FOREIGN PATENT DOCUMENTS

| | | |
|---|---|---|
| JP | 05-056135 U1 | 7/1993 |
| JP | 09-195834 A | 7/1997 |

(Continued)

*Primary Examiner* — Marguerite McMahon
*Assistant Examiner* — Tea Holbrook
(74) *Attorney, Agent, or Firm* — Finnegan, Henderson, Farabow, Garrett & Dunner, LLP

(57) ABSTRACT

A fuel supply apparatus for an internal combustion engine includes a fuel pump, a fuel pipe, a reduction valve, and an electronic control unit. The electronic control unit is configured to drive the fuel pump to rotate such that a required flow rate of the fuel is realized, while adjusting the fuel pressure in the fuel pipe to a target value, by driving the fuel pump to rotate. The electronic control unit is configured to operate the reduction valve to be opened when the operation state of the fuel pump is a first operation state. The first operation state is the operation state of the fuel pump where the frequency of the fuel pump has a value within a resonance area.

4 Claims, 3 Drawing Sheets

(56) References Cited

U.S. PATENT DOCUMENTS 5,727,529 A * 3/1998 Tuckey ..... F02D 33/003 123/497
5,884,597 A * 3/1999 Hiraku ..... F02M 59/04 123/179.17
6,102,010 A * 8/2000 Isozumi ..... F02M 63/0225 123/446
6,158,825 A 12/2000 Schunck et al.
6,431,147 B1 * 8/2002 Hiraiwa ..... F02M 37/10 123/458
6,453,878 B1 * 9/2002 Mazet ..... F02D 41/3082 123/497
9,309,849 B2 * 4/2016 Tanabe ..... F02M 59/366
9,435,311 B2 * 9/2016 Snodgrass
2002/0033167 A1 * 3/2002 Hiraku ..... F02D 41/3845 123/456
2002/0169042 A1 * 11/2002 Kurohata ..... F16H 7/0848 474/110
2005/0034710 A1 * 2/2005 Crary ..... F02M 33/08 123/457
2005/0193992 A1 * 9/2005 Shin ..... F02D 19/022 123/529
2006/0231079 A1 * 10/2006 Paluszewski ..... F02M 37/106 123/514
2006/0272618 A1 * 12/2006 Iwahashi ..... F02D 41/08 123/458
2007/0000478 A1 * 1/2007 Sadakane ..... F02D 41/38 123/431
2010/0139624 A1 * 6/2010 Surnilla ..... F02D 41/2464 123/511
2010/0313849 A1 * 12/2010 Stoner ..... F02D 41/22 123/350
2011/0238282 A1 * 9/2011 Saruwatari ..... F02D 41/2438 701/103
2013/0270471 A1 * 10/2013 Kamio ..... F16K 31/0675 251/129.15
2014/0224209 A1 * 8/2014 Pursifull ..... F02M 63/0001 123/294
2014/0278023 A1 * 9/2014 Roessle ..... F02D 41/065 701/113
2014/0348676 A1 * 11/2014 Kato ..... F04B 1/0452 417/437
2015/0027416 A1 * 1/2015 Brostrom ..... F02D 41/3845 123/495
2015/0147192 A1 * 5/2015 Pryor ..... F04B 53/001 417/53
2015/0285166 A1 * 10/2015 Surnilla ..... F02D 33/003 123/294
2015/0337753 A1 * 11/2015 Stickler ..... F02D 41/3845 123/506
2015/0337783 A1 * 11/2015 Pursifull ..... F02D 41/3845 123/496
2016/0025030 A1 * 1/2016 Ulrey ..... F02D 41/3854 123/294
2016/0138489 A1 * 5/2016 Lamm ..... F02D 41/3082 123/446
2016/0153384 A1 * 6/2016 Ulrey ..... F02D 41/3082 123/464

FOREIGN PATENT DOCUMENTS

JP 11-82222 3/1999
JP 2000-502011 A 2/2000
JP 2000-186602 7/2000
JP 2000-192832 7/2000
JP 2002-61529 2/2002
JP 2005-282476 A 10/2005
JP 2006-274923 10/2006
JP 2007-187009 7/2007
JP 2009-2262 1/2009
JP 2009-215909 9/2009
JP 2012-62770 3/2012
JP 2012237321 A * 12/2012
JP 2013-231373 11/2013
JP 2013231373 A * 11/2013
KR 101219332 B1 * 1/2013

* cited by examiner

1 ··· ENGINE
2 ··· FUEL TANK
3 ··· FUEL PUMP
4 ··· FUEL PIPE
5 ··· FUEL INJECTION DEVICE
6 ··· DELIVERY PIPE
8 ··· REDUCTION VALVE
9 ··· ELECTRONIC CONTROL UNIT
10 ··· ROTATION SPEED SENSOR
11 ··· ACCELERATOR POSITION SENSOR
12 ··· THROTTLE POSITION SENSOR
13 ··· AIR FLOW METER
14 ··· VEHICLE SPEED SENSOR
15 ··· FUEL PRESSURE SENSOR

FUEL SUPPLY APPARATUS FOR INTERNAL COMBUSTION ENGINE

INCORPORATION BY REFERENCE

The disclosure of Japanese Patent Application No. 2014-131228 filed on Jun. 26, 2014 including the specification, drawings and abstract is incorporated herein by reference in its entirety.

BACKGROUND OF THE INVENTION

1. Field of the Invention

The invention relates to a fuel supply apparatus for an internal combustion engine.

2. Description of Related Art

As illustrated in Japanese Patent Application Publication No. 2002-61529 (JP 2002-61529 A), a fuel supply apparatus for an internal combustion engine that is mounted on a vehicle such as a car is provided with a fuel pump that is driven to rotate so as to discharge a fuel to a fuel pipe which is connected to the internal combustion engine and a pressure regulator that allows the fuel in the pipe to appropriately flow out to the outside based on the fuel pressure in the fuel pipe.

Regarding the fuel supply apparatus, it is conceivable to drive the pump to rotate steadily and at a relatively high rotation speed so that the discharge flow rate of the fuel from the fuel pump sufficiently satisfies a required flow rate of the fuel supplied to the internal combustion engine. This is for the purpose of stably supplying the fuel to the internal combustion engine and simplifying fuel pump driving control. In this case, the surplus fuel in the fuel pipe that is not supplied to the internal combustion engine flows out of the fuel pipe through an operation of the pressure regulator.

When the fuel pump and a component in the vicinity of the fuel pump resonate while the fuel pump is driven to rotate, a resonant sound that is generated by the resonance may make a passenger in the vehicle feel uncomfortable. Accordingly, the rigidity of the component is set so that the natural frequency of the component has a distant value on a lower side with respect to the frequency of the fuel pump that is driven to rotate steadily and at a relatively high rotation speed as described above. Then, the frequency of the fuel pump that is available when the fuel pump is driven to rotate enters a resonance area including the natural frequency of the component, which leads to the suppression of the resonance of the fuel pump and the component in the vicinity of the fuel pump.

The natural frequency (resonance area) of the component is set in an area on the side lower than the frequency of the fuel pump that is available when the fuel pump is driven to rotate because the rigidity of the component needs to be increased and then the cost of the component increases when the resonance area is set in an area on a side higher than the frequency.

SUMMARY OF THE INVENTION

It is preferable to drive the fuel pump to rotate as follows, instead of driving the pump to rotate steadily and at a relatively high rotation speed as described above, in order to reduce energy consumption by the fuel pump. It is preferable that the fuel pump is driven to rotate so that the fuel is discharged from the fuel pump at a flow rate allowing the required flow rate of the fuel supplied to the internal combustion engine to be realized while the fuel pressure in the fuel pipe is adjusted to a target value. In this case, the fuel pump is not driven to rotate at an unnecessarily high rotation speed. The energy consumption by the fuel pump is reduced as the fuel pump is inhibited from being driven to rotate at such a high rotation speed.

When the fuel pump is driven to rotate in accordance with the required flow rate of the fuel supplied to the internal combustion engine, the rotation speed of the fuel pump shows a significant change, and this leads to a significant change in the frequency of the fuel pump. When the required flow rate of the fuel supplied to the internal combustion engine is decreased, the rotation speed of the pump may be reduced by the fuel pump being driven to rotate in accordance therewith and the frequency of the pump may decrease to the resonance area including the natural frequency of the component. The resonance of the fuel pump and the component occurs when the frequency of the fuel pump enters the resonance area in this manner.

The invention provides a fuel supply apparatus for an internal combustion engine that is capable of suppressing the resonance of a fuel pump and a component in the vicinity of the fuel pump when the fuel pump is driven to rotate so that a fuel is discharged from the fuel pump at a flow rate allowing a required flow rate of the fuel supplied to the internal combustion engine to be realized while the fuel pressure in a fuel pipe is adjusted to a target value.

According to an aspect of the invention, a fuel supply apparatus for an internal combustion engine includes a fuel pump, a fuel pipe, a reduction valve, and an electronic control unit. The fuel pipe is connected to the internal combustion engine. The fuel pump is configured to be driven so as to rotate to discharge a fuel to the fuel pipe. The reduction valve is configured to be operated to be opened and closed so as to allow an inside and an outside of the fuel pipe to communicate with or be blocked from the inside and the outside of the fuel pipe. The electronic control unit controls the fuel pump to be driven to rotate and controls the opening and closing operation of the reduction valve. The electronic control unit is configured to drive the fuel pump to rotate such that a required flow rate of the fuel is realized, while adjusting the fuel pressure in the fuel pipe to a target value, by driving the fuel pump to rotate. The electronic control unit is configured to open the reduction valve when an operation state of the fuel pump is a first operation state. The first operation state is the operation state of the fuel pump where the frequency of the fuel pump has a value within a resonance area.

In the aspect described above, the electronic control unit may be configured to determine the fuel pump to be in an operation state where the frequency has a value within the resonance area and open the reduction valve, when the required flow is less than a determination value.

In the aspect described above, the electronic control unit may be configured to adjust a degree of opening of the reduction valve to a value preceding the opening operation when the operation state of the fuel pump is a second operation state after opening the reduction valve when the operation state of the fuel pump is the first operation state. The second operation state is the operation state of the fuel pump where the frequency is away from the resonance area even when the reduction valve is opened.

In the aspect described above, the electronic control unit may be configured to stop the opening the reduction valve, even when the operation state of the fuel pump is the first operation state, when noise in a vehicle is greater than a resonant sound generated in the first operation state.

In the aspect described above, the electronic control unit may be configured to open the reduction valve when a noise in the vehicle is greater than a resonant sound generated as a result of the operation state of the fuel pump during opening of the reduction valve when the fuel pump is in the first operation state.

In the aspect described above, the electronic control unit may be configured to calculate a drive command value by using the fuel pressure in the fuel pipe and the required flow rate of the fuel. The electronic control unit may be configured to drive the fuel pump to rotate based on the drive command value. The electronic control unit may be configured to open the reduction valve when the drive command value is guarded by using a lower limit value. In addition, the electronic control unit may be configured to open the reduction valve when the drive command value becomes greater than the lower limit value and the lower limit value-based guarding is released during opening of the reduction valve based on the lower limit value-based guarding of the drive command value.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
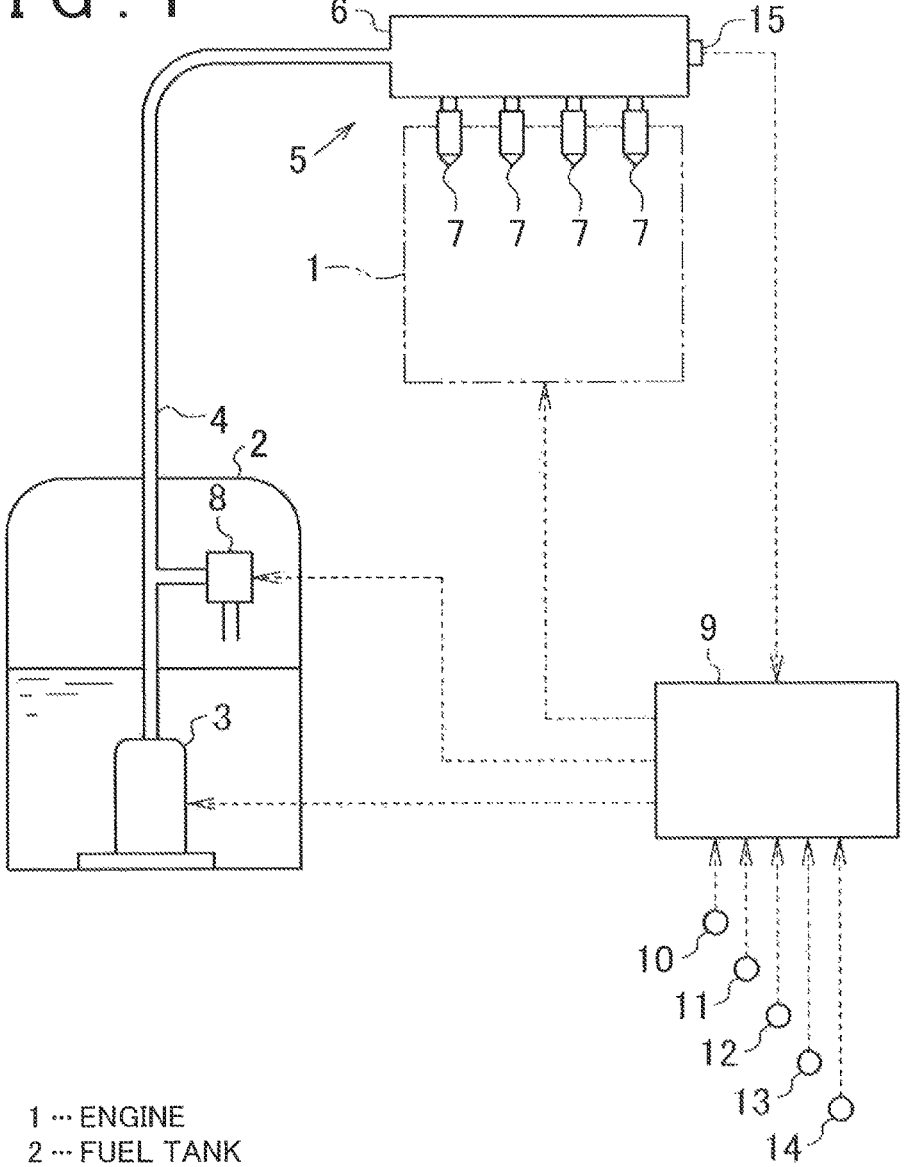
FIG. 1 is a schematic diagram illustrating a fuel supply apparatus for an internal combustion engine.

Hereinafter, an embodiment of a fuel supply apparatus for an internal combustion engine will be described with reference to FIGS. 1 to 3. The fuel supply apparatus for supplying a fuel to an internal combustion engine 1 that is illustrated in FIG. 1 is disposed in a vehicle on which the engine 1 is mounted. A fuel tank 2 that stores the fuel for the internal combustion engine 1 and an electric fuel pump 3 that pumps up the fuel in the fuel tank 2 are disposed in the fuel supply apparatus. The fuel pump 3 is connected to a fuel injection device 5 of the internal combustion engine 1, which is a supply destination for the fuel, via a fuel pipe 4.

When a voltage is applied to the fuel pump 3 based on a drive command value (voltage command value), the fuel pump 3 is driven to rotate in response to the applied voltage. The fuel pump 3 that is driven to rotate in this manner pumps up the fuel from the fuel tank 2 and discharges the fuel which is pumped up to the fuel pipe 4. The fuel that is discharged from the fuel pump 3 in this manner is supplied to the fuel injection device 5 via the fuel pipe 4.

The fuel injection device 5 of the internal combustion engine 1 is provided with a delivery pipe 6 that is connected to the fuel pipe 4 and a fuel injection valve 7 that receives the supply of the fuel from the delivery pipe 6. Fuel supply to the internal combustion engine 1 is performed through the fuel injection from the fuel injection valve 7. In addition, a reduction valve 8 that is opened or closed to allow the inside and the outside of the pipe 4 to communicate with or be blocked from each other is disposed in the fuel pipe 4 that connects the delivery pipe 6 and the fuel pump 3 to each other. Normally, the degree of opening of the reduction valve 8 is adjusted to a minimum value (for example, fully-closed state). When the reduction valve 8 is opened from the fully-closed state, the fuel in the fuel pipe 4 flows out of the fuel pipe 4, more specifically, into the fuel tank 2.

An electronic control unit 9 for performing various types of control relating to the operations of the vehicle and the internal combustion engine 1 is disposed in the fuel supply apparatus. The electronic control unit 9 is provided with a CPU that executes computation processing relating to the various types of control, a ROM in which a program and data required for the control are stored, a RAM in which the result of the computation by the CPU and the like are temporarily stored, I/O ports for signal input and output between the outside and the I/O ports, and the like.

Various sensors described below and the like are connected to the input port of the electronic control unit 9.

a rotation speed sensor 10 that detects an engine rotation speed an accelerator position sensor 11 that detects the amount of an operation performed on an accelerator pedal which is operated by a driver of the vehicle (accelerator operation amount)

a throttle position sensor 12 that detects the degree of opening of a throttle valve (throttle opening) of the internal combustion engine 1 an air flow meter 13 that detects the amount of intake air into the internal combustion engine 1 a vehicle speed sensor 14 that detects a vehicle speed a fuel pressure sensor 15 that detects fuel pressure in the fuel pipe 4 and the delivery pipe 6

A drive circuit for various instruments of the internal combustion engine 1, a drive circuit for the fuel pump 3, and a drive circuit for the reduction valve 8 are connected to the output port of the electronic control unit 9.

The electronic control unit 9 grasps a required vehicle traveling state, a required engine operation state, an actual vehicle traveling state, and an actual engine operation state based on detection signals input from the various sensors and outputs command signals to the various drive circuits connected to the output port based thereon. The various types of control for the engine 1 such as fuel injection control for the internal combustion engine 1 are executed in this manner, and control for driving the fuel pump 3 to rotate, control for the opening and closing operation of the reduction valve 8, and the like are carried out through the electronic control unit 9. During the execution of the control for driving the fuel pump 3 to rotate and the control for the opening and closing operation of the reduction valve 8, the electronic control unit 9 functions as a control unit for executing the control of the fuel pump 3 and the reduction valve 8.

Normally, the electronic control unit 9 maintains the reduction valve 8 in a closed state (fully-closed state) as the control for the opening and closing operation of the reduction valve 8. In addition, the electronic control unit 9 drives the pump 3 to rotate so that the fuel is discharged from the fuel pump 3 at a flow rate allowing a required flow rate Qr to be realized while adjusting a fuel pressure Pf to a determined target value based on the required flow rate Qr of the fuel and the fuel pressure Pf in the fuel pipe 4 available during the supply of the fuel to the internal combustion engine 1 by the fuel injection device 5. Specifically, the electronic control unit 9 obtains a voltage command value V, which is the drive command value for the fuel pump 3, based on the required flow rate Qr and the fuel pressure Pf, and drives the pump 3 to rotate by applying a voltage corresponding to the voltage command value V to the fuel pump 3. The required flow rate Qr is obtained based on an engine rotation speed NE, an engine load KL, a gain correction amount K for the fuel injection amount for the internal combustion engine 1, and the like. The engine load KL is obtained based on, for example, parameters relating to the amount of the intake air into the internal combustion engine 1, such as the accelerator operation amount, the throttle opening, and an actual measured value of the intake air amount, and the engine rotation speed NE. The fuel pressure Pf is detected by the fuel pressure sensor 15.

Energy consumption by the fuel pump 3 is reduced because, as described above, the reduction valve 8 is normally maintained in the fully-closed state so that no fuel flows out to the outside from the fuel pipe 4 and the pump 3 is driven to rotate so that the fuel is discharged from the fuel pump 3 at the flow rate allowing the required flow rate Qr to be realized while the fuel pressure Pf is adjusted to the target value. This is because the fuel pump 3 is not driven to rotate at an unnecessarily high rotation speed and the pump 3 is driven to rotate so that the fuel is discharged from the fuel pump 3 at the required flow rate.

When the voltage command value V for driving the fuel pump 3 to rotate is obtained based on the required flow rate Qr and the fuel pressure Pf, the electronic control unit 9 guards the obtained voltage command value V by using a lower limit value determined in advance. This has to do with the fact that it is difficult for the fuel pump 3 to appropriately discharge the fuel in a rotation drive area where the fuel has a low discharge flow rate. In other words, the obtained voltage command value V is guarded by using the lower limit value and the voltage command value V is prevented from becoming less than the lower limit value so that the fuel pump 3 is prevented from being driven to rotate in this area.

When the voltage command value V is guarded by using the lower limit value, the discharge flow rate of the fuel pump 3 enters a state of being excessively high with respect to the required flow rate Qr, and thus the electronic control unit 9 allows the surplus fuel in the fuel pipe 4 to flow out to the outside (fuel tank 2) by opening the reduction valve 8, which is normally in the closed state. The electronic control unit 9 is configured to close the reduction valve 8 (to reach the fully-closed state), which is a value preceding the opening operation, when the voltage command value V obtained based on the required flow rate Qr and the fuel pressure Pf exceeds the lower limit value and the lower limit value-based guarding of the voltage command value V is released during the opening operation for the reduction valve 8 based on the lower limit value-based guarding of the voltage command value V.

When the fuel pump 3 is driven to rotate, the fuel pump 3 and a component in the vicinity of the fuel pump 3 (for example, the fuel tank 2) may resonate. Specifically, the fuel pump 3 and the fuel tank 2 resonate when the frequency of the fuel pump 3 that is driven to rotate is within a resonance area A including the natural frequency X of the fuel tank 2. When the fuel pump 3 and the fuel tank 2 resonate as described above, the resonant sound that is caused by the resonance may make a passenger in the vehicle feel uncomfortable.

Figure 2:
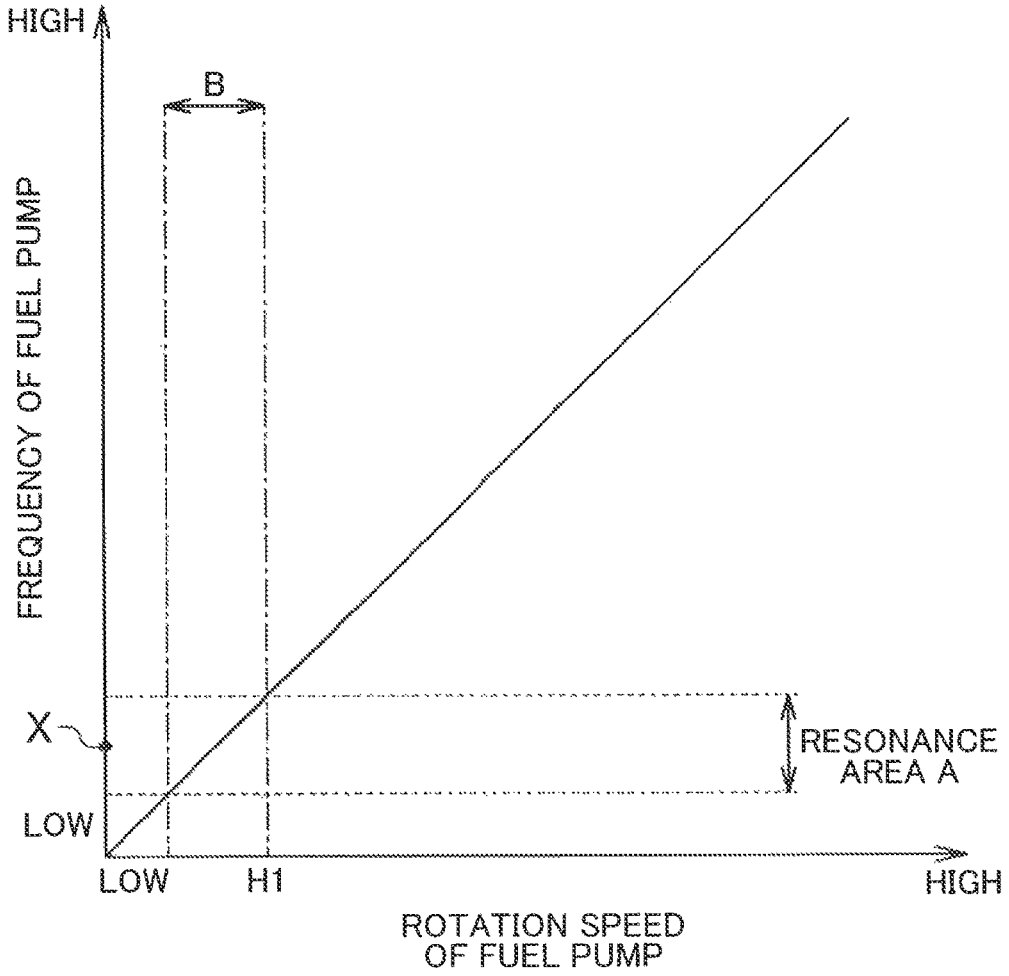
FIG. 2 is a graph illustrating a relationship between the rotation speed and the frequency of a fuel pump.

As illustrated in FIG. 2, the frequency of the fuel pump 3 increases as the rotation speed of the pump 3 increases. Herein, it is conceivable to drive the pump 3 to rotate steadily and at a relatively high rotation speed, as in a fuel supply apparatus of the related art, so that the discharge flow rate of the fuel from the fuel pump 3 sufficiently satisfies the required flow rate Qr. The fuel pump 3 can be driven to rotate steadily and at a relatively high rotation speed as described above when the voltage command value V of the fuel pump 3 is fixed at a high value. It is also conceivable that the surplus fuel in the fuel pipe 4 that is generated in this case as the fuel pump 3 is driven to rotate is returned to the fuel tank 2 by a pressure regulator or the like.

In a case where this situation is assumed, the natural frequency X of the fuel tank 2 is set as follows. The rigidity of the component or the like is set so that the natural frequency X of the fuel tank 2 has a value distant from the frequency of the fuel pump 3 that is driven to rotate steadily and at a high rotation speed as described above. The natural frequency X is set in an area on a side lower than the frequency of the fuel pump 3 driven to rotate, through a reduction in the rigidity of the fuel tank 2 or the like, due to a relationship in which the cost of the pump 3 is increased as the rigidity of the fuel tank 2 is to be increased. FIG. 2 illustrates the resonance area A that is available when the natural frequency X of the fuel tank 2 is set as described above. FIG. 2 also illustrates a rotation speed area B of the fuel pump 3 corresponding to the resonance area A.

The fuel pump 3 is driven to rotate so that the fuel is discharged from the fuel pump 3 at the flow rate allowing the required flow rate Qr to be realized, while the fuel pressure Pf is adjusted to the target value, so that the energy consumption by the pump 3 is reduced. In a case where the fuel pump 3 is driven to rotate in this manner, the rotation speed of the fuel pump 3 shows a significant change, and this results in a significant change in the frequency of the fuel pump 3. When the required flow rate Qr of the fuel that is supplied to the internal combustion engine 1 decreases, the rotation speed of the pump 3 may be reduced and the frequency of the pump 3 may decrease to the resonance area A as the fuel pump 3 is driven to rotate in response thereto. The fuel pump 3 and the fuel tank 2 resonate and the resonant sound is generated when the frequency of the fuel pump 3 enters the resonance area A as described above.

In order to tackle this problem, the electronic control unit 9 executes resonance suppression processing when the pump 3 is in an operation state where the frequency of the fuel pump 3 driven to rotate has a value within the resonance area A including the natural frequency X of the fuel tank 2. The resonance suppression processing is an opening of the reduction valve 8, which is normally maintained in the closed state, so that the reduction valve 8 reaches the fully-open state. When the reduction valve 8 is opened in this manner, the fuel in the fuel pipe 4 flows out to the fuel tank 2 for the fuel pressure Pf in the pipe 4 to be reduced. In this case, the fuel pump 3 is driven to rotate so that the fuel pressure Pf in the fuel pipe 4 is maintained at the target value, and thus the rotation speed of the fuel pump 3 can be increased while the required flow rate Qr of the fuel supplied to the internal combustion engine 1 is realized. Since the frequency of the pump 3 increases as a result of the increase in the rotation speed of the fuel pump 3, the frequency is inhibited from having a value within the resonance area A.

Figure 3:
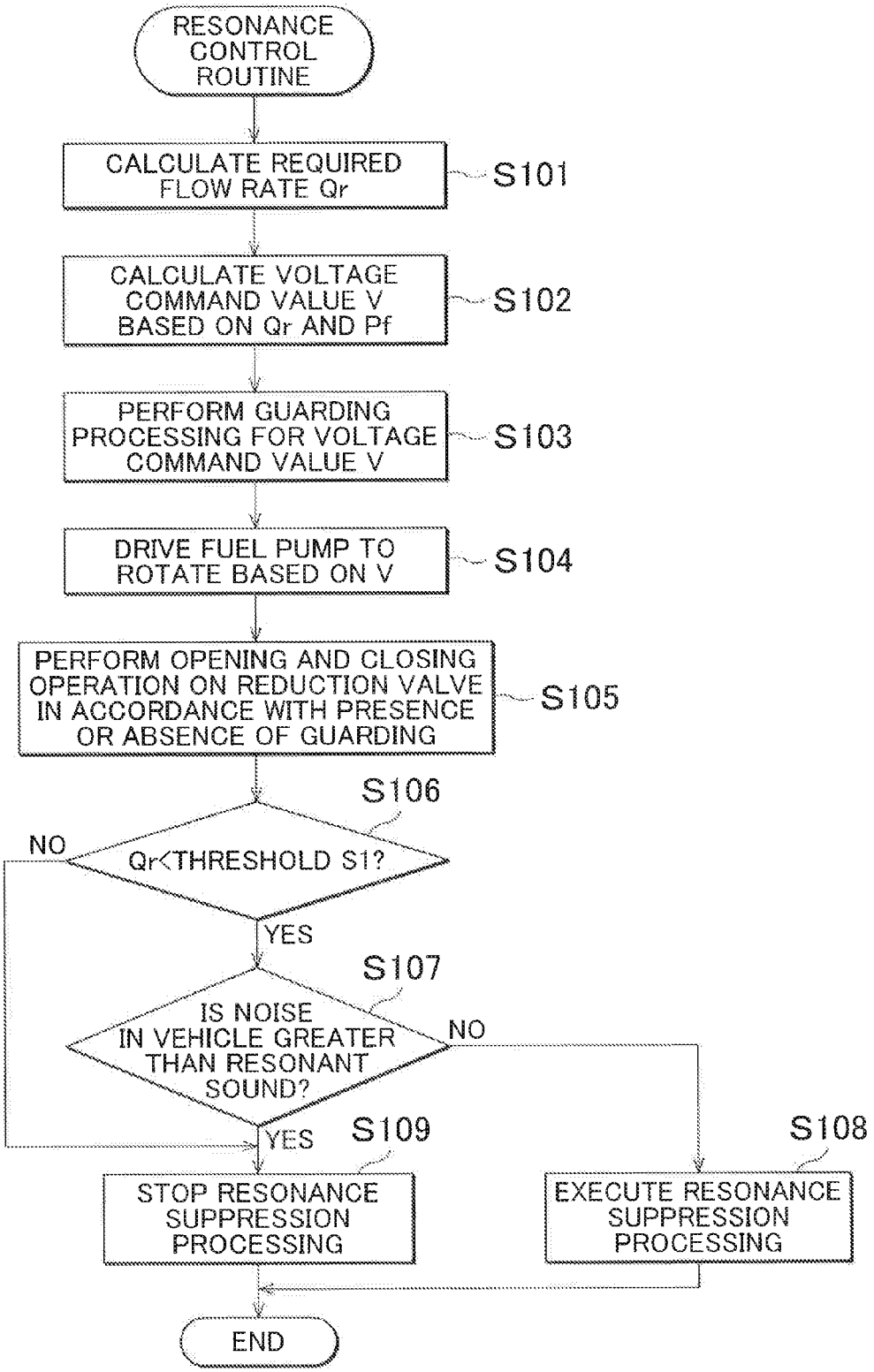
FIG. 3 is a flowchart illustrating a resonance suppression processing execution procedure.

FIG. 3 is a flowchart illustrating a resonance suppression routine for the execution of the resonance suppression processing. The resonance suppression routine is periodically executed by the electronic control unit 9 at, for example, time interrupt at every predetermined time.

The electronic control unit 9 calculates, as the processing of Step 101 (S101) of the resonance suppression routine, the required flow rate Qr of the fuel during the supply of the fuel to the internal combustion engine 1 based on the engine rotation speed NE, the engine load KL, the gain correction amount K for the fuel injection amount, and the like. Then, the processing proceeds to S102. The processing of S102 to S104 is to drive the fuel pump 3 to rotate.

The electronic control unit 9 calculates the voltage command value V of the fuel pump 3 based on the required flow rate Qr and the fuel pressure Pf as the processing of S102 and guards the calculated voltage command value V by using the lower limit value determined in advance as the processing of S103. In other words, the voltage command value V is set to the lower limit value so that the voltage command value V does not become less than the lower limit value when the calculated voltage command value V is less than the lower limit value. The electronic control unit 9 drives the pump 3 to rotate by applying a voltage corresponding to the voltage command value V to the fuel pump 3 as the subsequent processing of S104. Then, the processing proceeds to S105.

The electronic control unit 9 executes, as the processing of S105, the control for the opening and closing operation of the reduction valve 8 based on the presence or absence of the lower limit value-based guarding of the voltage command value V in S103. Specifically, the electronic control unit 9 maintains the reduction valve 8 in the closed state as usual when the lower limit value-based guarding of the voltage command value V is not performed and opens the reduction valve 8 in the closed state to be opened to reach the fully-open state when the lower limit value-based guarding of the voltage command value V is performed. In this case, the surplus fuel in the fuel pipe 4 is allowed to flow out to the fuel tank 2 by the opening of the reduction valve 8, even if the discharge flow rate of the fuel pump 3 is in a state of being excessively high with respect to the required flow rate Qr, when the voltage command value V is guarded by using the lower limit value. While the reduction valve 8 is open, the electronic control unit 9 closes the open reduction valve 8 when the voltage command value V that is calculated in S102 becomes greater than the lower limit value and the lower limit value-based guarding of the voltage command value V in S103 becomes unexecuted (released). In other words, the degree of opening of the reduction valve 8 is adjusted to the value preceding the opening operation. The processing proceeds to S106 after the execution of the processing of S105. The processing of S106 is to determine whether or not the pump 3 is in the operation state where the frequency of the fuel pump 3 has a value within the resonance area A.

As illustrated in FIG. 2, the rotation speed area B of the fuel pump 3 corresponding to the resonance area A is an area near the minimum value in the entire range of the change in the rotation speed of the fuel pump 3 which is driven to rotate based on the voltage command value V. Accordingly, it can be determined that the pump 3 is in the operation state where the frequency of the fuel pump 3 has a value within the resonance area A when the rotation speed of the fuel pump 3 is less than a determination value H1 which is the upper limit of the rotation speed area B.

The electronic control unit 9 determines, as the processing of S106 in FIG. 3, whether or not the required flow rate Qr is less than a threshold S1. The threshold S1 is obtained as follows. A relationship between the fuel pressure Pf and the required flow rate Qr pertaining to a case where the rotation speed of the fuel pump 3 is adjusted to the determination value H1 (FIG. 2) is defined in advance in a map through an experiment or the like, and the required flow rate Qr is calculated by referring to the map and based on the fuel pressure Pf. Then, the required flow rate Qr that is calculated from the map is set as the threshold S1.

A case where the required flow rate Qr that is calculated in S101 is less than the threshold S1 set in this manner means that the rotation speed of the fuel pump 3 becomes less than the determination value H1. Accordingly, in a case where it is determined in S106 that the required flow rate Qr is less than the threshold S1, the determination to that effect means that the rotation speed of the fuel pump 3 becomes less than the determination value H1, and the pump 3 is determined to be in the operation state where the frequency of the fuel pump 3 has a value within the resonance area A. The processing proceeds to S109 in the case of a negative determination in S106. The electronic control unit 9 stops the resonance suppression processing for opening the reduction valve 8 in the closed state to be opened to reach the fully-open state as the processing of S109, and then temporarily terminates the resonance suppression routine. The processing proceeds to S107 in the case of a positive determination in S106.

The electronic control unit 9 determines, as the processing of S107, whether or not the noise in the vehicle caused by the road noise during the traveling of the vehicle or the like is greater than the resonant sound generated by the resonance of the fuel tank 2 and the fuel pump 3 as a result of the operation state of the pump 3 where the frequency of the fuel pump 3 has a value within the resonance area A. Specifically, the electronic control unit 9 determines whether or not a vehicle speed Vc that is detected by the vehicle speed sensor 14 is greater than or equal to a predetermined value, and determines that the noise in the vehicle is less than the resonant sound in the case of a negative determination herein. In other words, the predetermined value is set in advance to an appropriate value, through an experiment or the like, so that this determination can be performed. The processing proceeds to S108 in a case where it is determined in S107 that the noise in the vehicle is less than the resonant sound.

The electronic control unit 9 executes, as the processing of S108, the resonance suppression processing for opening the reduction valve 8 to reach the fully-open state. The reduction valve 8 is normally maintained in the closed state, except when the voltage command value V is guarded by using the lower limit value, so that the energy consumption by the fuel pump 3 is reduced. When the reduction valve 8, which is normally maintained in the closed state as described above, is opened through the execution of the resonance suppression processing, the fuel in the fuel pipe 4 flows out to the fuel tank 2 for the fuel pressure Pf in the pipe 4 to be reduced. As a result, the voltage command value V increases so that the fuel pressure Pf in the fuel pipe 4 is maintained at the target value, the fuel pump 3 is driven to rotate based on the increased voltage command value V, the rotation speed of the fuel pump 3 increases, and the frequency of the fuel pump 3 increases. When the frequency of the fuel pump 3 increases as described above, the frequency is inhibited from having a value within the resonance area A, and, eventually, the resonance of the fuel pump 3 and the fuel tank 2 is suppressed. The electronic control unit 9 temporarily terminates the resonance suppression routine after the execution of the processing of S108.

The processing proceeds to S109 in a case where it is determined in S107 that the noise in the vehicle caused by the road noise during the traveling of the vehicle or the like is greater than the resonant sound generated by the resonance of the fuel tank 2 and the fuel pump 3, that is, in a case where the vehicle speed Vc is determined to be greater than the predetermined value. The electronic control unit 9 enters, as the processing of Step S109, a state where the resonance suppression processing is stopped. Specifically, the electronic control unit 9 stops the opening operation for the reduction valve 8 and maintains the closed state of the reduction valve 8 if the reduction valve 8 has yet to be opened in accordance with the resonance suppression processing and closes the reduction valve 8 if the reduction valve 8 is being operated to be opened in accordance with the resonance suppression processing. In other words, the degree of opening of the reduction valve 8 is adjusted to the value preceding the opening operation.

The processing of S109 is also executed when the required flow rate Qr becomes greater than the threshold S1 and a negative determination is carried out in S106 during the opening operation for the reduction valve 8 in accordance with the resonance suppression processing. The required flow rate Qr becoming equal to or greater than the threshold S1 during the opening of the reduction valve 8 in accordance with the resonance suppression processing means that the frequency of the fuel pump 3 enters a state of being away from the resonance area A despite the closing of the reduction valve 8. Even in this case, the execution of the resonance suppression processing is stopped in the processing of S109 and the open reduction valve 8 is closed by the execution of the resonance suppression processing. In other words, the degree of opening of the reduction valve 8 is adjusted to the value preceding the opening operation.

Next, an effect of the fuel supply apparatus for an internal combustion engine 1 will be described. When the rotation speed of the fuel pump 3 is reduced due to a decrease in the required flow rate Qr, the frequency of the fuel pump 3 may enter the resonance area A. When the fuel pump 3 is in the operation state where the frequency of the fuel pump 3 has a value within the resonance area A, the resonance suppression processing for opening the reduction valve 8, which is normally maintained in the closed state. After the reduction valve 8 is opened by the resonance suppression processing, the rotation speed of the fuel pump 3 increases and the frequency of the fuel pump 3 increases with the required flow rate Qr realized while the fuel pressure Pf in the fuel pipe 4 is maintained at the target value. Then, the frequency of the fuel pump 3 is inhibited from having a value within the resonance area A.

The following effects are achieved by this embodiment described above. The resonance of the fuel pump 3 and the fuel tank 2 can be suppressed through the execution of the resonance suppression processing when the pump 3 is driven to rotate so that the fuel is discharged from the fuel pump 3 at the flow rate allowing the required flow rate Qr of the fuel supplied to the internal combustion engine 1 to be realized while the fuel pressure Pf in the fuel pipe 4 is adjusted to the target value. In addition, the generation of the resonant sound due to the resonance of the fuel pump 3 and the fuel tank 2 can be suppressed, and the discomfort of the passenger in the vehicle attributable to the generation of the resonant sound can be suppressed.

When the frequency of the fuel pump 3 enters the state of being away from the resonance area A despite the closing of the reduction valve 8 during the opening of the reduction valve 8 in accordance with the resonance suppression processing, the execution of the resonance suppression processing is stopped and the reduction valve 8 is closed. When the reduction valve 8 is opened, more energy is consumed while the fuel pump 3 is driven to rotate so as to maintain the fuel pressure Pf in the fuel pipe 4 at the target value than when the reduction valve 8 is closed. Accordingly, when the frequency of the fuel pump 3 enters the state of being away from the resonance area A despite the closing of the reduction valve 8 as described above, an increase in the energy consumption by the fuel pump 3 attributable to the open state of the reduction valve 8 can be suppressed by stopping the execution of the resonance suppression processing and closing the reduction valve 8.

The opening operation for the reduction valve 8 in the closed state in accordance with the resonance suppression processing is stopped, even when the frequency of the fuel pump 3 is within the resonance area A, that is, even when the required flow rate Qr is less than the threshold S1, when the noise in the vehicle is greater than the resonant sound that is caused by the resonance of the fuel pump 3 and the fuel tank 2. In this case, the opening of the reduction valve 8 in the closed state for resonance suppression is stopped in the case of a situation in which the passenger is not bothered by the resonant sound as in the case of the noise in the vehicle being greater than the resonant sound, and thus an increase in the energy consumption by the fuel pump 3 that results from the opening of the reduction valve 8 can be suppressed.

When the reduction valve 8 is in the open state as a result of the execution of the resonance suppression processing and the noise in the vehicle is greater than the resonant sound generated by the resonance of the fuel pump 3 and the fuel tank 2, the resonance suppression processing is stopped and the reduction valve 8 is closed. Even in this case, the reduction valve 8 that is in the open state for resonance suppression is closed in the case of a situation in which the passenger is not bothered by the resonant sound as in the case of the noise in the vehicle being greater than the resonant sound, and thus an increase in the energy consumption by the fuel pump 3 that results from the opening of the reduction valve 8 can be suppressed.

The fuel pump 3 is driven to rotate as a result of the application of the voltage corresponding to the voltage command value V. The voltage command value V is calculated based on the required flow rate Qr of the fuel supplied to the internal combustion engine 1 and the fuel pressure Pf in the fuel pipe 4. The reduction valve 8 is opened when the voltage command value V that is calculated in this manner is guarded by using the lower limit value. The reduction valve 8 is closed when the voltage command value V becomes greater than the lower limit value and the lower limit value-based guarding is released during the opening of the reduction valve 8 resulting from the lower limit value-based guarding of the voltage command value V.

The lower limit value-based guarding of the voltage command value V is performed so as to drive the pump 3 to rotate while avoiding the rotation drive area where the fuel from the fuel pump 3 has a low discharge flow rate, that is, a rotation drive area where it is difficult to appropriately discharge the fuel from the fuel pump 3. The opening and closing of the reduction valve 8 based on the presence or absence of the lower limit value-based guarding of the voltage command value V is performed so as to allow the surplus fuel in the fuel pipe 4 to flow out to the fuel tank 2 through the opening of the reduction valve 8 when the fuel pump 3 is in a state of having an excessively high discharge flow rate during the execution of the guarding.

The opening and closing of the reduction valve 8 based on the presence or absence of the guarding is performed separately from the opening and closing of the reduction valve 8 in accordance with whether or not the pump 3 is in the operation state where the frequency of the fuel pump 3 has a value within the resonance area A. Accordingly, the fuel pressure Pf in the fuel pipe 4 can be inhibited from becoming greater than the target value, even in a state where the fuel pump 3 has an excessively high discharge flow rate, when the lower limit value-based guarding of the voltage command value V is performed so as to prevent the fuel pump 3 from being driven to rotate in the rotation drive area where the fuel has a low discharge flow rate, that is, the rotation drive area where it is difficult to appropriately discharge the fuel.

The embodiment described above can also be modified as follows for example.

When it is determined whether or not the noise in the vehicle is greater than the resonant sound based on whether or not the vehicle speed Vc is equal to or greater than the predetermined value, the predetermined value may vary depending on the presence or absence of fuel cut in the internal combustion engine 1. In this case, it is preferable that the predetermined value is greater when the fuel cut is present than when the fuel cut is absent.

For example, the resonance suppression processing may be executed regardless of whether or not the noise in the vehicle is greater than the resonant sound. When the degree of opening of the reduction valve 8 is adjusted to the minimum value, the reduction valve 8 does not necessarily have to be in the fully-closed state and may be in a state of being adjusted to have a degree of opening on a further open side than in the fully-closed state.

When the reduction valve 8 is operated to be opened in accordance with the resonance suppression processing, the reduction valve 8 does not necessarily have to be in the fully-open state, and the degree of opening of the reduction valve 8 may be adjusted to an open side until reaching a value on a further closed side than in the fully-open state.

A sensor that detects the rotation speed of the fuel pump 3 may be disposed and it may be determined that the pump is in the operation state where the frequency of the fuel pump 3 has a value within the resonance area A when the rotation speed of the fuel pump 3 that is detected by the sensor is within the rotation speed area B.

The rotation speed of the fuel pump 3 may be estimated based on the voltage applied to the fuel pump 3 and the fuel pressure Pf in the fuel pipe 4 and it may be determined that the pump is in the operation state where the frequency of the fuel pump 3 has a value within the resonance area A when the estimated rotation speed of the fuel pump 3 is within the rotation speed area B.

The fuel tank 2 has been described as an example of the component resonating with the fuel pump 3. In a case where a component other than the fuel tank 2 resonates with the fuel pump 3, however, the component may be suppressed by using a device for suppressing resonance.

When the fuel pump is in the operation state where the frequency of the fuel pump has the value within the resonance area including the natural frequency of the component present in the vicinity of the pump, the resonance of the fuel pump and the component may occur as a result of the frequency having the value within the resonance area. When the fuel pump is in the operation state where the frequency has the value within the resonance area, the reduction valve is operated to be opened by the electronic control unit. Then, more of the fuel in the fuel pipe flows out to the outside, and the fuel pressure in the fuel pipe is reduced. In this case, the fuel pump is driven to rotate so that the fuel pressure in the fuel pipe is maintained at the target value. As a result, the rotation speed of the fuel pump can be raised while the required flow rate of the fuel supplied to the internal combustion engine is realized. The rise in the rotation speed of the fuel pump causes the frequency of the fuel pump to increase. In this manner, the frequency of the fuel pump is inhibited from having the value within the resonance area.

Accordingly, it is possible to suppress the resonance of the fuel pump and the component in the vicinity of the fuel pump when the fuel pump is driven to rotate so that the fuel is discharged from the fuel pump at the flow rate allowing the required flow rate of the fuel supplied to the internal combustion engine to be realized while the fuel pressure in the fuel pipe is adjusted to the target value.

When the reduction valve is operated to be opened, more energy is consumed, than before the opening operation, while the fuel pump is driven to rotate so as to maintain the fuel pressure in the fuel pipe at the target value. Accordingly, when the fuel pump is in the second operation state as described above, the increase in the energy consumption by the fuel pump can be suppressed by adjusting the degree of opening of the reduction valve in the opening operation state to the value preceding the opening operation.

In a situation in which the noise in the vehicle is greater than the resonant sound, a passenger is not bothered by the resonant sound. In this situation, the opening operation for the reduction valve for resonance suppression is stopped, and thus the increase in the energy consumption by the fuel pump that results from the opening operation can be suppressed.

In a rotation drive area where the fuel has a low discharge flow rate, it is difficult for the fuel pump to appropriately discharge the fuel. In order to prevent the fuel pump from being driven to rotate in the area, the control unit described above guards the obtained drive command value by using the lower limit value so that the obtained drive command value does not become less than the lower limit value. In addition, when the drive command value is guarded by using the lower limit value, the fuel pump enters a state where the discharge flow rate is excessive. Accordingly, the reduction valve is operated to be opened and the surplus fuel in the fuel pipe flows out to the outside.

The opening and closing of the reduction valve based on the presence or absence of the lower limit value-based guarding of the drive command value is performed separately from the opening and closing of the reduction valve in accordance with whether or not the fuel pump is in the operation state where the frequency of the fuel pump has a value within the resonance area. Accordingly, the fuel pressure in the fuel pipe can be inhibited from becoming greater than the target value, even in a state where the fuel pump has an excessively high discharge flow rate, when the lower limit value-based guarding of the drive command value is performed so as to prevent the fuel pump from being driven to rotate in the rotation drive area where the fuel has the low discharge flow rate, that is, the rotation drive area where it is difficult to appropriately discharge the fuel.

What is claimed is:

1. A fuel supply apparatus for an internal combustion engine, comprising:

a fuel pipe connected to the internal combustion engine;

a fuel pump configured to be driven to rotate so as to discharge a fuel to the fuel pipe;

a reduction valve configured to be operated between a fully-closed state, so as to prevent fuel from flowing out of the fuel pipe, and a fully-opened state, so as to allow fuel to flow out of the fuel pipe; and an electronic control unit for controlling the fuel pump to be driven to rotate and controlling the opening and closing operation of the reduction valve, the electronic control unit configured to (a) drive the fuel pump to rotate such that a required flow rate of the fuel supplied to the internal combustion engine is realized, while adjusting a fuel pressure in the fuel pipe to a target value, and (b) open the reduction valve when an operation state of the fuel pump is a first operation state, the first operation state being the operation state of the fuel pump where a frequency of the fuel pump has a value within a resonance area, wherein the electronic control unit is configured to determine the fuel pump to be in an operation state where the frequency has a value within the resonance area and open the reduction valve, when the required flow is less than a threshold value.

2. A fuel supply apparatus for an internal combustion engine, comprising:

a fuel pipe connected to the internal combustion engine;

a fuel pump configured to be driven to rotate so as to discharge a fuel to the fuel pipe;

a reduction valve configured to be operated between a fully-closed state, so as to prevent fuel from flowing out of the fuel pipe, and a fully-opened state, so as to allow fuel to flow out of the fuel pipe; and an electronic control unit for controlling the fuel pump to be driven to rotate and controlling the opening and closing operation of the reduction valve, the electronic control unit configured to (a) drive the fuel pump to rotate such that a required flow rate of the fuel supplied to the internal combustion engine is realized, while adjusting a fuel pressure in the fuel pipe to a target value, and (b) open the reduction valve when an operation state of the fuel pump is a first operation state, the first operation state being the operation state of the fuel pump where a frequency of the fuel pump has a value within a resonance area, wherein the electronic control unit is configured to adjust a degree of opening of the reduction valve to a value preceding the opening operation when the operation state of the fuel pump is a second operation state after opening the reduction valve when the operation state of the fuel pump is the first operation state, the second operation state being the operation state of the fuel pump where the frequency is away from the resonance area even when the reduction valve is closed.

3. A fuel supply apparatus for an internal combustion engine, comprising:

a fuel pipe connected to the internal combustion engine;

a fuel pump configured to be driven to rotate so as to discharge a fuel to the fuel pipe;

a reduction valve configured to be operated between a fully-closed state, so as to prevent fuel from flowing out of the fuel pipe, and a fully-opened state, so as to allow fuel to flow out of the fuel pipe; and an electronic control unit for controlling the fuel pump to be driven to rotate and controlling the opening and closing operation of the reduction valve, the electronic control unit configured to (a) drive the fuel pump to rotate such that a required flow rate of the fuel supplied to the internal combustion engine is realized, while adjusting a fuel pressure in the fuel pipe to a target value, and (b) open the reduction valve when an operation state of the fuel pump is a first operation state, the first operation state being the operation state of the fuel pump where a frequency of the fuel pump has a value within a resonance area, wherein the electronic control unit is configured to stop opening the reduction valve, even when the operation state of the fuel pump is the first operation state, when noise in a vehicle is greater than a resonant sound generated in the first operation state.

4. A fuel supply apparatus for an internal combustion engine, comprising:

a fuel pipe connected to the internal combustion engine;

a fuel pump configured to be driven to rotate so as to discharge a fuel to the fuel pipe;

a reduction valve configured to be operated between a fully-closed state, so as to prevent fuel from flowing out of the fuel pipe, and a fully-opened state, so as to allow fuel to flow out of the fuel pipe; and an electronic control unit for controlling the fuel pump to be driven to rotate and controlling the opening and closing operation of the reduction valve, the electronic control unit configured to (a) drive the fuel pump to rotate such that a required flow rate of the fuel supplied to the internal combustion engine is realized, while adjusting a fuel pressure in the fuel pipe to a target value, and (b) open the reduction valve when an operation state of the fuel pump is a first operation state, the first operation state being the operation state of the fuel pump where a frequency of the fuel pump has a value within a resonance area, wherein the electronic control unit is configured to close the reduction valve when a noise in the vehicle is greater than a resonant sound generated as a result of the operation state of the fuel pump during opening of the reduction valve when the fuel pump is in the first operation state.

* * * * *